US012624900B2

(12) United States Patent
Lee et al.

(10) Patent No.: US 12,624,900 B2
(45) Date of Patent: May 12, 2026

(54) HEAT EXCHANGER

(71) Applicants: HYUNDAI WIA Corporation, Changwon-si (KR); KORENS Inc., Yangsan-si (KR)

(72) Inventors: Hyeong Gi Lee, Uiwang-si (KR); Sang Min Lee, Uiwang-si (KR); Won Sang Lee, Yangsan-si (KR); Do Gyu Kim, Busan (KR)

(73) Assignees: Hyundai Wia Corporation, Changwon-si (KR); Korens Inc., Yangsan-si (KR)

( * ) Notice: Subject to any disclaimer, the term of this patent is extended or adjusted under 35 U.S.C. 154(b) by 321 days.

(21) Appl. No.: 18/341,647

(22) Filed: Jun. 26, 2023

(65) Prior Publication Data

US 2024/0003638 A1 Jan. 4, 2024

(30) Foreign Application Priority Data

Jul. 1, 2022 (KR) ..... 10-2022-0081389

(51) Int. Cl.
*F28D 9/00* (2006.01)
*F28F 3/08* (2006.01)

(52) U.S. Cl.
CPC ..... *F28D 9/0093* (2013.01); *F28D 9/0043* (2013.01); *F28F 3/08* (2013.01)

(58) Field of Classification Search
CPC ..... F28D 9/005; F28D 9/0056; F28D 9/0093; F28D 9/0037; F28F 3/086
See application file for complete search history.

(56) References Cited

U.S. PATENT DOCUMENTS 6,142,221 A * 11/2000 Johansson ..... F28D 9/005 165/140
7,866,379 B2 1/2011 Murayama et al.
2007/0125527 A1* 6/2007 Flik ..... F28D 7/1692 165/140

(Continued)

FOREIGN PATENT DOCUMENTS

EP 2322891 A2 5/2011
JP 2000-283682 A 10/2000

(Continued)

OTHER PUBLICATIONS

Office Action received in Korean Application No. 10-2022-0081389 dated Mar. 20, 2024.

(Continued)

*Primary Examiner* — Jianying C Atkisson
*Assistant Examiner* — For K Ling
(74) *Attorney, Agent, or Firm* — Knobbe, Martens, Olson & Bear, LLP

(57) ABSTRACT

A heat exchanger is disclosed. A first heat-exchanging plate, in which plural kinds of cooling water are circulated, and a second heat-exchanging plate, in which refrigerant is circulated, have respective independent flow channels to prevent mixing between the cooling water and the refrigerant. The first and second heat-exchanging plates have respective guides, which are layered so as to form an overlapping structure, thereby improving coupling capability and durability when the first and second heat-exchanging plates are welded to each other in the state of being layered.

14 Claims, 7 Drawing Sheets

(56) References Cited

U.S. PATENT DOCUMENTS

| | | | | |
|---|---|---|---|---|
| 2007/0267000 | A1* | 11/2007 | Raduenz | F02M 26/32 165/158 |
| 2017/0176047 | A1* | 6/2017 | Kondo | B23P 15/26 |
| 2019/0063846 | A1* | 2/2019 | Bluetling | F28D 9/0093 |
| 2022/0236017 | A1* | 7/2022 | Benouali | H01M 10/625 |
| 2023/0324128 | A1* | 10/2023 | Choi | F28D 9/0037 165/140 |

FOREIGN PATENT DOCUMENTS

| | | | | | |
|---|---|---|---|---|---|
| JP | 2003194488 | A | * | 7/2003 | F28D 9/0043 |
| KR | 10-2009-0043005 | A | | 5/2009 | |
| KR | 10-2021-0010121 | A | | 1/2021 | |
| KR | 10-2021-0019775 | A | | 2/2021 | |
| KR | 10-2021-0072861 | A | | 6/2021 | |
| KR | 10-2022-007536 | A | | 1/2022 | |
| WO | WO 2022/010313 | | | 1/2022 | |

OTHER PUBLICATIONS

Office Action received in corresponding DE Application No. 102023117005.8 dated Oct. 21, 2025.

* cited by examiner

HEAT EXCHANGER

CROSS-REFERENCE TO RELATED APPLICATION

This application claims the priority benefit of Korean Patent Application No. 10-2022-0081389, filed on Jul. 1, 2022 in the Korean Intellectual Property Office, the entire disclosure of which is incorporated herein by reference.

BACKGROUND

1. Field

The present disclosure relates to a heat exchanger capable of performing heat exchange between cooling water and refrigerant.

2. Description of the Related Art

In general, a heat exchanger is an apparatus configured to perform heat exchange in such a manner that one of different heat-exchanging media discharges heat to the other and the other of the different heat-exchanging media absorbs the heat. The heat exchangers are variously manufactured so as to be applied to a condenser and an evaporator which use refrigerant as a heat-exchanging medium, a radiator and a heater core which use cooling water as a heat-exchanging medium, and an oil cooler which uses oil, which has been used in an engine, a transmission or the like, as a heat-exchanging medium, depending on the intended use.

Details described as the background art are intended merely for the purpose of promoting an understanding of the background of the present disclosure and should not be construed as an acknowledgment of the prior art that is already known to those of ordinary skill in the art.

SUMMARY

Aspects of the present disclosure provide a heat exchanger in which plural kinds of cooling water and refrigerant are circulated in respective independent flow channels and which assures coupling capability and durability of a first heat-exchanging plate in which cooling water is circulated and a second heat-exchanging plate in which refrigerant is circulated and prevents mixing between heat-exchanging media.

In accordance with the present disclosure, the above and other aspects can be accomplished by the provision of a heat exchanger including a housing including first and second cooling water inlet ports and first and second cooling water outlet ports, through which cooling water is circulated, and a refrigerant inlet port and a refrigerant outlet port, through which refrigerant is circulated, a first heat-exchanging plate to which the first and second cooling water inlet ports and the first and second cooling water outlet ports are connected and which includes a first guide configured to define a cooling water channel, and a second heat-exchanging plate to which the refrigerant inlet port and the refrigerant outlet port are connected and which includes a second guide configured to define a refrigerant channel, wherein each of the first heat-exchanging plate and the second heat-exchanging plate includes a plurality of heat-exchanging plates, and the plurality of first heat-exchanging plates and the plurality of second heat-exchanging plates are alternately layered, and wherein the first guide and the second guide form an overlapping structure such that one of the first guide and the second guide is inserted into the other of the first guide and the second guide when the first heat-exchanging plate and the second heat-exchanging plate are layered.

The first cooling water inlet port and the first cooling water outlet port may be provided at a first side of an upper portion of the housing and the second cooling water inlet port and the second cooling water outlet port may be provided at a second side of the upper portion of the housing, and the refrigerant inlet port and the refrigerant outlet port may be provided at portions of the housing which do not overlap the first cooling water inlet port or the second cooling water inlet port.

The first heat-exchanging plate may be provided at the first and second sides thereof with cooling water holes, which respectively communicate with the first cooling water inlet portion, the first cooling water outlet port, the second cooling water inlet port, and the second cooling water outlet port so as to allow cooling water to be circulated therethrough, and the first heat-exchanging plate may be provided in a central area thereof with first through holes, through which the refrigerant inlet port and the refrigerant outlet port extend.

The second heat-exchanging plate may be provided at the first and second sides thereof with second through holes, through which the first cooling water inlet port, the first cooling water outlet port, the second cooling water inlet port, and the second cooling water outlet port extend, and the second heat-exchanging plate may be provided in a central area thereof with refrigerant holes, which communicate with the refrigerant inlet port and the refrigerant outlet port.

The first guide may include a first central partition wall, which extends at a central area on the first heat-exchanging plate to divide the first heat-exchanging plate into a first side and a second side, a first side partition wall, which extends toward the second side from the first side of the first heat-exchanging plate to define a cooling water channel between the first cooling inlet and the first cooling water outlet port, and a second side partition wall, which extends toward the first side from the second side of the first heat-exchanging plate to define a cooling water channel between the second cooling water inlet port and the second cooling water outlet port.

The second guide may include a second central partition wall disposed between the refrigerant inlet port and the refrigerant outlet port, a third side partition wall, which extends toward the first side from the second central partition wall, and a fourth side partition wall, which extends toward the second side from the second central partition wall.

The first central partition wall and the second central partition wall may be positioned so as to correspond to each other in a vertical direction and to be partially engaged with each other, and one of engaging portions of the first central partition wall and the second central partition wall may be inserted into another of the first central partition wall and the second central partition wall.

The engaging portion of the first central partition wall that is engaged with the second central partition wall may project so as to be inserted into the second central partition wall, a remaining portion of the first central partition wall may project so as to be in contact with a lower surface of the second heat-exchanging plate, and the second central partition wall may project so as to be inserted into the first central partition wall.

The first heat-exchanging plate may include a first insertion portion, which is formed at a location at which the engaging portion of the first central partition wall meets the remaining portion of the first central partition wall and which gradually decreases in width moving upwards, and the second heat-exchanging plate may include a second insertion portion, which is formed at a location on the second central partition wall corresponding to the first insertion portion and which has the same shape as the first insertion portion.

The first side partition wall and the third side partition wall may be positioned so as to correspond to each other in a vertical direction and to be partially engaged with each other, one of the engaging portions of the first side partition wall and the third side partition wall being inserted into another of the first side partition wall and the third side partition wall, and the second side partition wall and the fourth side partition wall may be positioned so as to correspond to each other in a vertical direction and to be partially engaged with each other, one of the engaging portions of the second side partition wall and the fourth side partition wall being inserted into another of the second side partition wall and the fourth side partition wall.

The engaging portion of the first side partition wall that is engaged with the third side partition wall projects so as to be inserted into the third side partition wall, a remaining portion of the first side partition wall projecting so as to be in contact with the second heat-exchanging plate, and the engaging portion of the third side partition wall that is engaged with the first side partition wall may project so as to be inserted into the first side partition wall, a remaining portion of the third side partition wall projecting so as to be in contact with the first heat-exchanging plate.

The first heat-exchanging plate may include first insertion portions, which are formed at a location at which the engaging portion of the first side partition wall meets the remaining portion of the first side partition wall and at an end of the first side partition wall and each of which gradually decreases in width moving upwards, and the second heat-exchanging plate may include second insertion portions, which are formed at locations on the third side partition wall corresponding to the first insertion portions and each of which has the same shape as a corresponding one of the first insertion portions.

The engaging portion of the second side partition wall that is engaged with the fourth side partition wall may project so as to be inserted into the fourth side partition wall, a remaining portion of the second side partition wall projecting so as to be in contact with the second heat-exchanging plate, and the engaging portion of the fourth side partition wall that is engaged with the second side partition wall may project so as to be inserted into the second side partition wall, a remaining portion of the fourth side partition wall projecting so as to be in contact with the first heat-exchanging plate.

The first heat-exchanging plate may include first insertion portions, which are formed at a location at which the engaging portion of the second side partition wall meets the remaining portion of the second side partition wall and at an end of the second side partition wall and each of which gradually decreases in width moving upwards, and the second heat-exchanging plate may include second insertion portions, which are formed at locations on the fourth side partition wall corresponding to the first insertion portions and each of which has the same shape as a corresponding one of the first insertion portions.

Each of a portion of the first guide, which abuts a peripheral edge of the first heat-exchanging plate, and a portion of the second guide, which abuts a peripheral edge of the second heat-exchanging plate, may gradually increase in width moving outwards.

Each of the first heat-exchanging plate and the second heat-exchanging plate may include a plurality of protrusions formed thereon.

Each of the first heat-exchanging plate and the second heat-exchanging plate may include an extension, which extends obliquely upwards or downwards from a peripheral edge thereof, and the extension of the first heat-exchanging plate and the extension of the second heat-exchanging plate may be in contact with each other when the first heat-exchanging plate and the second heat-exchanging plate are layered.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF EMBODIMENTS

Reference will now be made in detail to embodiments of the present disclosure, examples of which are illustrated in the accompanying drawings. Wherever possible, the same reference numbers will be used throughout the drawings to refer to the same or like parts.

Air conditioning technology using a heat exchanger is attracting a lot of attention with the development of electric transporter technology. In order to improve efficiency of air conditioning in an electric transporter, energy consumption is reduced through efficient heat exchange between refrigerant and cooling water.

In one example technology, a heat exchanger uses a cooling water plate, in which cooling water is circulated, and a refrigerant plate, in which refrigerant is circulated, in order to perform heat exchange between cooling water and the refrigerant via the cooling water plate and the refrigerant plate.

The refrigerant plate, in which refrigerant is circulated, is provided with a partition wall for refrigerant in order to construct a structure for circulating refrigerant, and the cooling water plate, in which cooling water is circulated, is provided with a partition wall for cooling water in order to construct a structure for circulating cooling water. Here, although it is possible to form flow channels in which different kinds of fluid are circulated by virtue of the respective partition walls, a dead zone may need to be present on the cooling water plate and the refrigerant plate in order to form the respective partition. In other words, when the cooling water plate and the refrigerant plate are coupled to each other, there is a need for a portion at which the cooling water partition wall and the refrigerant partition wall are coupled to each other. This portion serves as a dead zone, thereby creating a region in which heat exchange is not performed. This may cause deterioration of efficiency of heat exchange.

In addition, because a groove may need to be formed in one of the cooling water partition wall and the refrigerant partition wall which intersect each other in order to form a cross structure when the cooling plate and the refrigerant plate are coupled to each other, it is possible that heat-exchanging fluid is mixed through the groove.

Hereinafter, a heat exchanger according to an embodiment of the present disclosure will be described with reference to the accompanying drawings.

Figure 1:
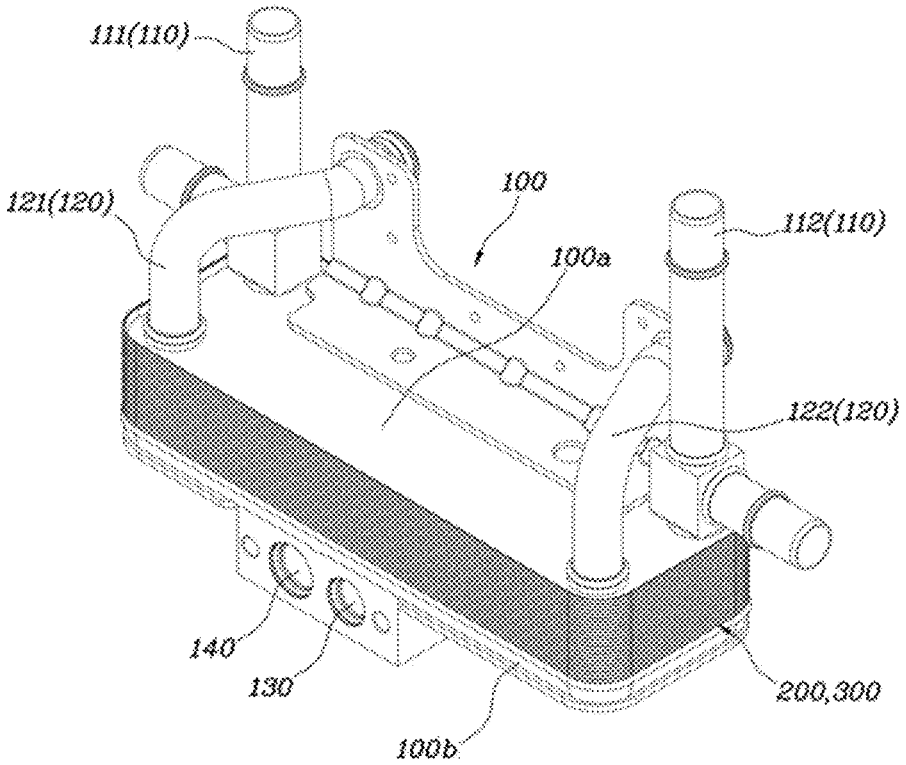
FIG. 1 is a view illustrating a heat exchanger according to the present disclosure.
Figure 2:
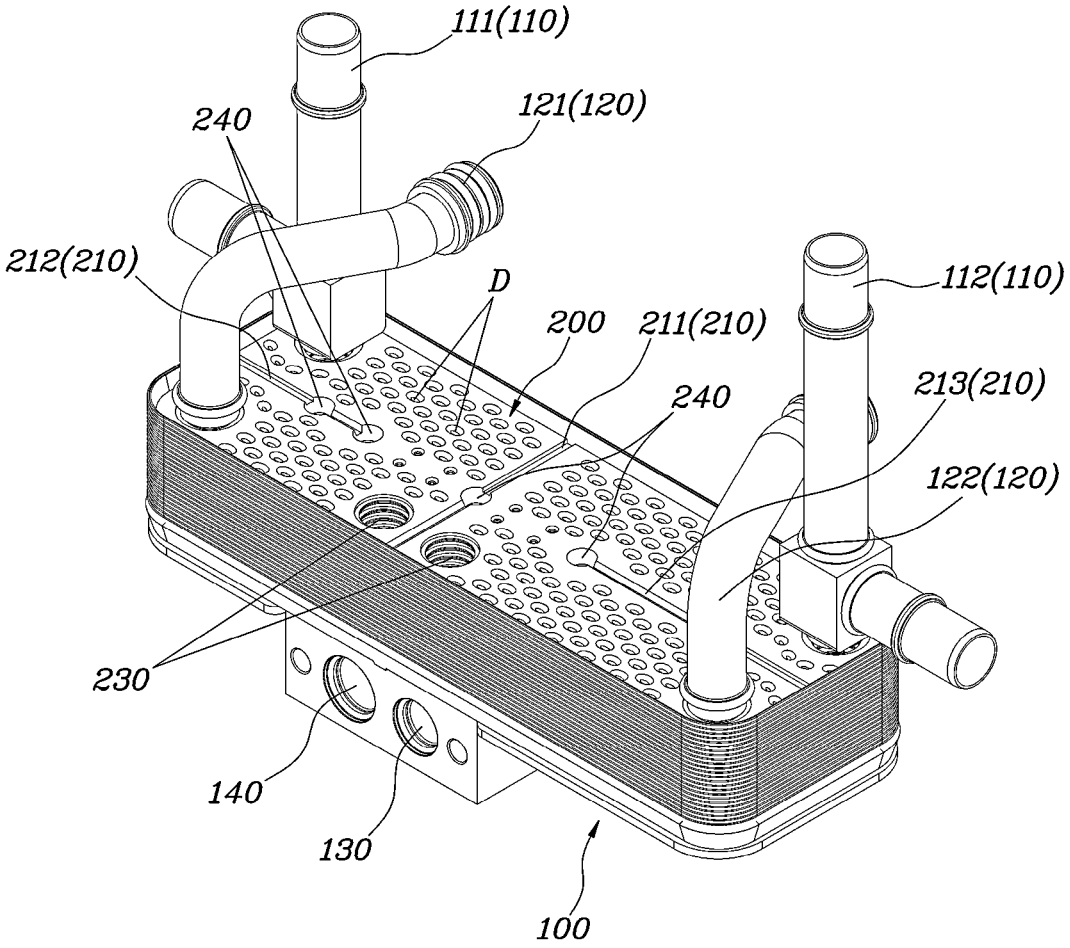
FIG. 2 is a view illustrating the interior of a first heat-exchanging plate of the heat exchanger shown in FIG. 1.
Figure 3:
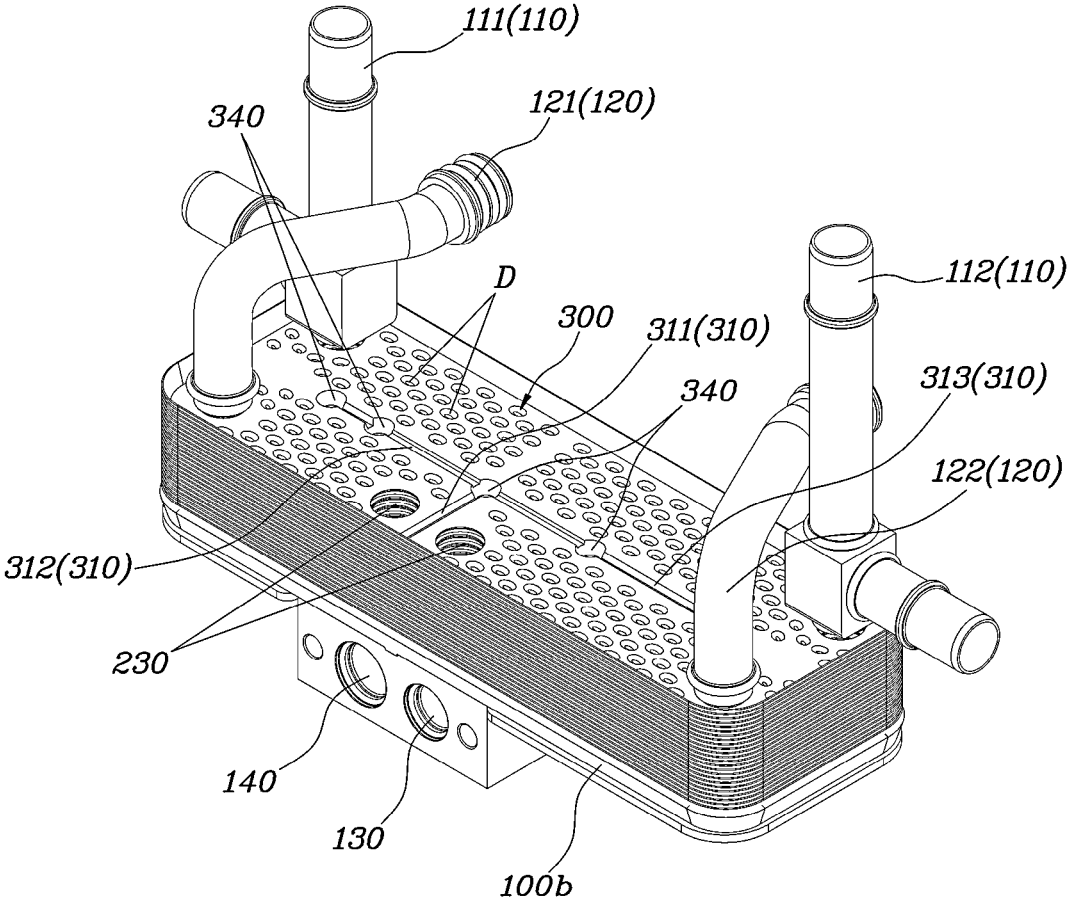
FIG. 3 is a view illustrating the interior of a second heat-exchanging plate of the heat exchanger shown in FIG. 1.
Figure 4:
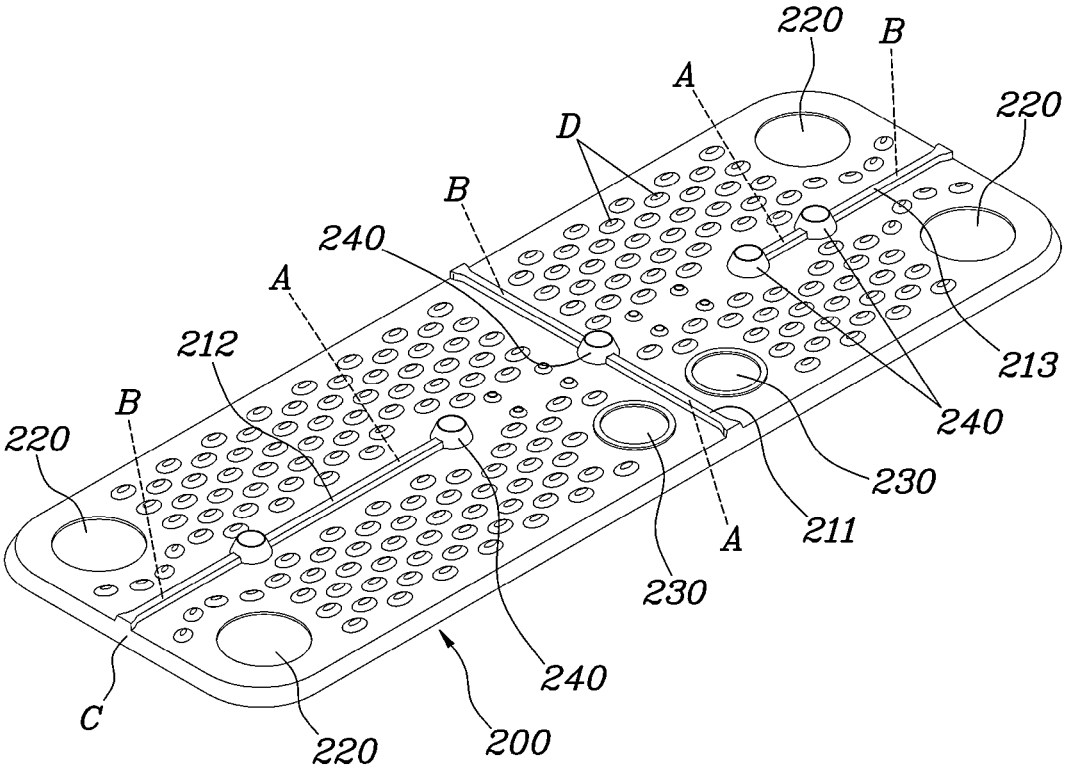
FIG. 4 is a view illustrating the first heat-exchanging plate according to an embodiment of the present disclosure.
Figure 5:
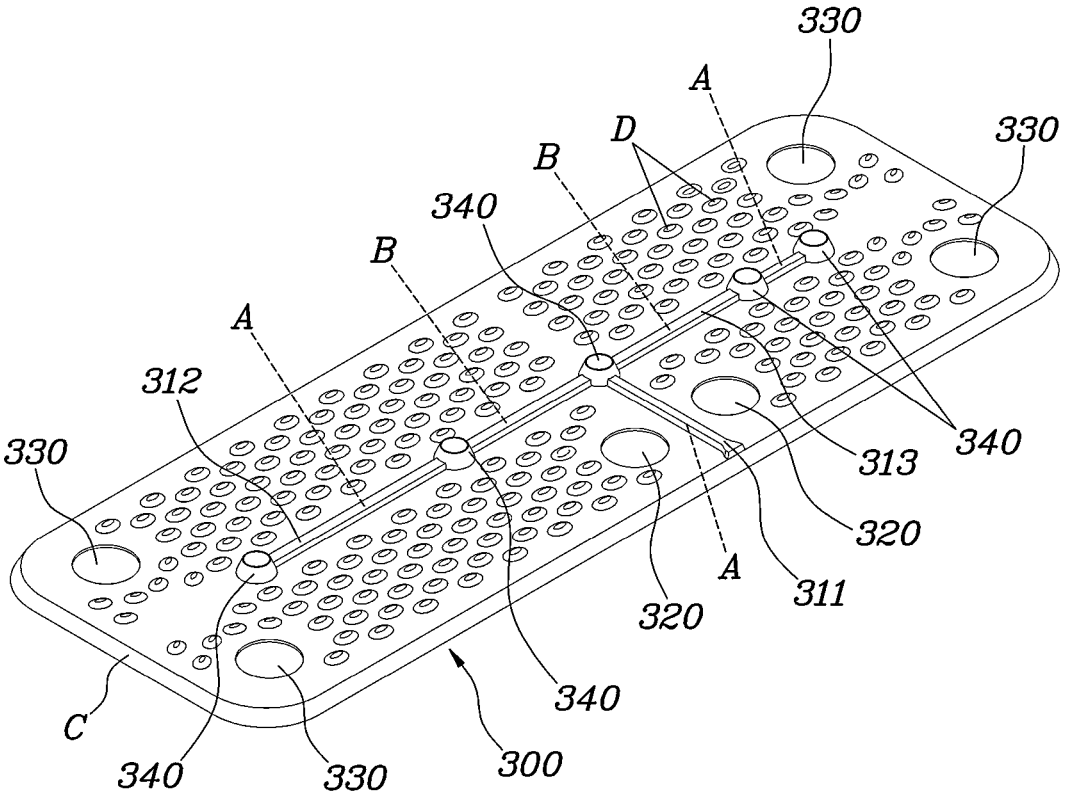
FIG. 5 is a view illustrating the second heat-exchanging plate according to an embodiment of the present disclosure.
Figure 6:
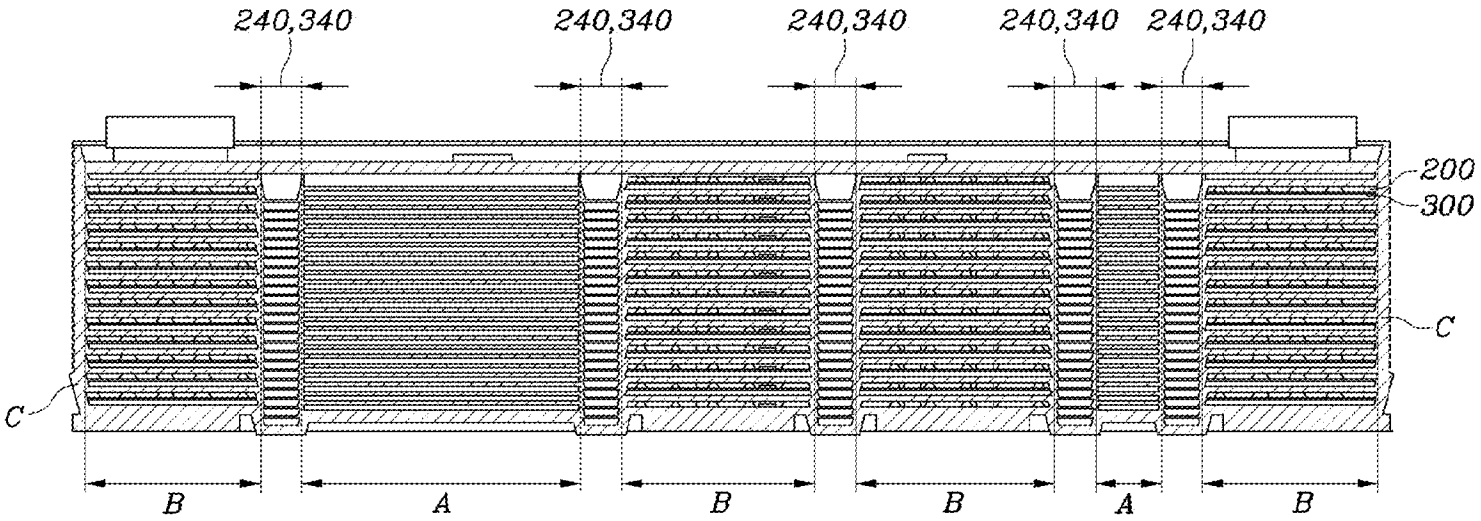
FIG. 6 is a side view of the heat exchanger according to the present disclosure.
Figure 7:
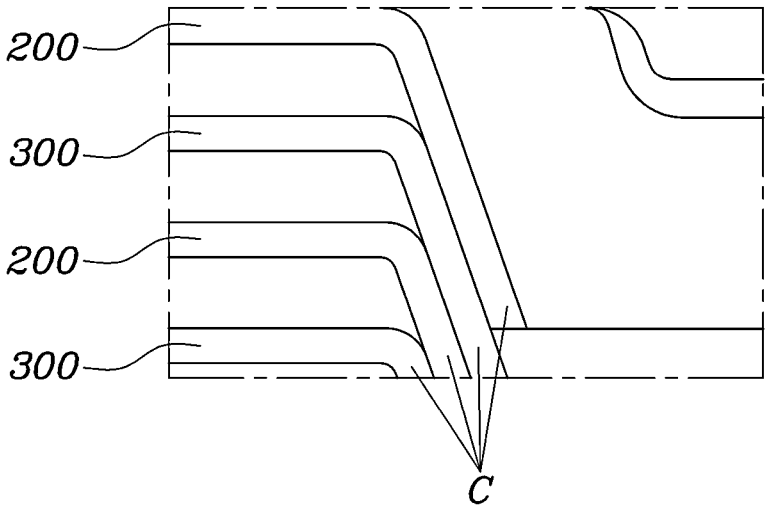
FIG. 7 is a view illustrating the connection between the first heat-exchanging plate and the second heat-exchanging plate according to the present disclosure.

FIG. 1 is a view illustrating the heat exchanger according to the present disclosure. FIG. 2 is a view illustrating the interior of a first heat-exchanging plate of the heat exchanger shown in FIG. 1. FIG. 3 is a view illustrating the interior of a second heat-exchanging plate of the heat exchanger shown in FIG. 1. FIG. 4 is a view illustrating the first heat-exchanging plate according to an embodiment of the present disclosure. FIG. 5 is a view illustrating the second heat-exchanging plate according to an embodiment of the present disclosure. FIG. 6 is a side view of the heat exchanger according to the present disclosure. FIG. 7 is a view illustrating the connection between the first heat-exchanging plate and the second heat-exchanging plate according to the present disclosure.

As illustrated in FIGS. 1 to 6, the heat exchanger according to the present disclosure includes a housing 100, which includes a cooling water inlet port 110 and a cooling water outlet port 120, through which cooling water is introduced and discharged, and a refrigerant inlet port 130 and a refrigerant outlet port 140, through which refrigerant is introduced and discharged, a heat-exchanging plate 200, to which the cooling water inlet port 110 and the cooling water outlet port 120 are connected and which includes a first guide 210 defining a cooling water channel, and a second heat-exchanging plate 300, to which the refrigerant inlet port 130 and the refrigerant outlet port 140 are connected and which includes a second guide 310 defining a refrigerant channel.

The housing 100 may include an upper case 100*a* and a lower case 100*b*, which accommodates therein the first heat-exchanging plate 200 and the second heat-exchanging plate 300. Specifically, the upper case 100*a* of the housing 100 may be provided with the cooling water inlet port 110 and the cooling water outlet port 120, and the lower case 100*b* of the housing 100 may be provided with the refrigerant inlet port 130 and the refrigerant outlet port 140.

Each of the first heat-exchanging plate 200 and the second heat-exchanging plate 300 may include a plurality of heat-exchanging plates, and the plurality of first heat-exchanging plates 200 and the second heat-exchanging plates 300 are alternately layered. Consequently, cooling water and refrigerant exchange heat with each other via the first heat-exchanging plate 200 and the second plate 300. Here, the first heat-exchanging plate 200 may include the first guide 210 formed in one side surface thereof such that the cooling water channel is formed from the cooling water inlet port 110 to the cooling water outlet port 120 so as to allow cooling water to flow therethrough. Meanwhile, the second heat-exchanging plate 300 may include the second guide 310 formed in one side surface thereof such that the refrigerant channel is formed from the refrigerant inlet portion 130 to the refrigerant outlet port 140 so as to allow refrigerant to flow therethrough. The first guide 210 may allow cooling water to be circulated throughout the one side surface of the first heat-exchanging plate 200, and the second guide 310 may allow refrigerant to be circulated throughout the one side surface of the second heat-exchanging plate 300, thereby improving efficiency of heat exchange between the cooling water and the refrigerant.

Specifically, the first guide 210 and the second guide 310 may be constructed so as to overlap each other such that one of the first guide 210 and the second guide 310 is partially inserted into the other of the first guide 210 and the second guide 310 when the first heat-exchanging plate 200 and the second heat-exchanging plate 300 are layered on top of one another. In other words, the first guide 210 may extend to define the cooling water channel, and the second guide 310 may extend to define the refrigerant channel. The first guide 210 and the second guide 310 are engaged with each other in a partial area or the entire area in a direction in which the first heat-exchanging plate 200 and the second heat-exchanging plate 300 are layered. Here, since one of the engaging portions A of the first guide 210 and the second guide 310 is inserted into the other of the engaging portions A so as to form an overlapping structure, direct flow of cooling water or refrigerant is blocked, coupling capability between the first heat-exchanging plate 200 and the second heat-exchanging plate 300 is improved, and a dead zone is omitted. In other words, in the previously mentioned example technology, when partition walls configured to define a cooling channel or a refrigerant channel are formed, there is a dead zone configured to avoid interference between the partition walls, and an additional interference-avoiding hole may need to be provided. In contrast, according to the present disclosure, since the first guide 210 and the second guide 310 are constructed so as to overlap each other, the dead zone and additional hole are omitted, thereby preventing the heat-exchanging media from being mixed with each other through the hole.

As described above, the first guide 210 and the second guide 310 may extend to define the cooling water channel and the refrigerant channel, respectively. Since the first guide 210 and the second guide 310 overlap each other in an insertion manner in the engaging portions A, and are coupled to the first heat-exchanging plate 200 or the second heat-exchanging plate 300 in the remaining portion B, rigidity of the finished product is improved, and mixing between the heat-exchanging media is prevented.

The above-described present disclosure will now be described in more detail. The housing 100 may include a first cooling water inlet port 111 and a first cooling water outlet port 121, which are provided at one side of the upper portion thereof, and a second cooling water inlet port 112 and a second cooling water outlet port 122, which are provided at the opposite side of the upper portion thereof. Furthermore, the housing 100 may include the refrigerant inlet port 130 and the refrigerant outlet port 140, which are provided in an area that does not overlap the first cooling water inlet port 111 and the second cooling water inlet port 112.

According to the present disclosure, the cooling water may include first cooling water, which is circulated through the first cooling water inlet port 111 and the second cooling water outlet port 121, and second cooling water, which is circulated through the second cooling water inlet port 112 and the second cooling water outlet port 122. The first and second cooling water may be controlled to have different temperatures. The first and second cooling water may be separately circulated or mixed with each other in the cooling water circuit in order to control temperatures thereof. The refrigerant may be circulated through the refrigerant inlet port 130 and the refrigerant outlet port 140.

In addition, since the cooling water inlet port 110 and the cooling water outlet port 120 are provided at the upper portion of the housing 100, and the refrigerant inlet port 130 and the refrigerant outlet port 140 are provided at the lower portion of the housing 100, it is easy to simplify the circulation paths for the cooling water and the refrigerant. As described above, the present disclosure is constructed such that plural kinds of cooling water, which are controlled to have different temperatures, exchange heat with the refrigerant.

The first heat-exchanging plate 200 according to an embodiment of the present disclosure may include cooling water holes 220 formed at opposite sides thereof, which communicate with the first cooling water inlet port 111, the first cooling water outlet port 121, the second cooling water inlet port 112, and the second cooling water outlet port 122, and may include first through holes 230 formed in the center thereof, which communicate with the refrigerant inlet port 130 and the refrigerant outlet port 140.

In other words, as illustrated in FIGS. 2 and 4, the first heat-exchanging plate 200 may include the cooling water holes 220 formed at opposite sides thereof such that the first cooling water, which is circulated through the first cooling water inlet port 111 and the first cooling water outlet port 121, and the second cooling water, which is circulated through the second cooling water inlet port 112 and the second cooling water outlet port 122, flow in the first heat-exchanging plate 200. Furthermore, the first heat-exchanging plate 200 may include the first through holes 230 formed in the center thereof such that the refrigerant inlet port 130 and the refrigerant outlet port 140 are connected to the second heat-exchanging plate 300 for communication therebetween through the first heat-exchanging plate 200.

Meanwhile, the second heat-exchanging plate 300 may include second through holes 330 formed at opposite sides thereof such that the first cooling water inlet port 111, the first cooling water outlet port 121, the second cooling water inlet port 112, and the second cooling water outlet port 122 extend through the respective second through holes 330. Furthermore, the second heat-exchanging plate 300 may include refrigerant holes 320 formed in the center thereof such that the refrigerant inlet port 130 and the refrigerant outlet port 140 communicate with the refrigerant holes 320.

As illustrated in FIGS. 3 and 5, since the second heat-exchanging plate 300 is provided in the center thereof with the refrigerant inlet port 130 and the refrigerant outlet port 140, the refrigerant, which is circulated through the refrigerant inlet port 130 and the refrigerant outlet port 140, flows in the second heat-exchanging plate 300. Furthermore, since the second heat-exchanging plate 300 is provided at opposite sides thereof with the second through holes 330, the first cooling water inlet port 111 and the first cooling water outlet port 121 extend through the second heat-exchanging plate 300 at one side and the second cooling water inlet port 112 and the second cooling water outlet port 122 and through the second heat-exchanging plate 300 at the opposite side, and are connected to the first heat-exchanging plate 200 for communication therebetween.

Consequently, the cooling water and the refrigerant may separately flow through the first heat-exchanging plate 200 and the second heat-exchanging plate 300, and the cooling water and the refrigerant may exchange heat with each other via the first heat-exchanging plate 200 and the second heat-exchanging plate 300.

The first guide 210 may include a first central partition wall 211, which extends in the center of the first heat-exchanging plate 200 to divide the first heat-exchanging plate 200 into the one side and the opposite side, a first side partition wall 212, which extends toward the opposite side from the one side of the first heat-exchanging plate 200 to define a cooling water channel between the first cooling water inlet port 111 and the first cooling water outlet port 121, and a second side partition wall 213, which extends toward the one side from the opposite side of the first heat-exchanging plate 200 to define a cooling channel between the second cooling water inlet port 112 and the second cooling water outlet port 122.

As illustrated in FIG. 4, the first guide 210 may be composed of the first central partition wall 211, the first side partition wall 212, and the second side partition wall 213. Here, the first central partition wall 211 may extend through the center line of the first heat-exchanging plate 200 to isolate the cooling water, which flows through the first cooling water inlet port 111 and the first cooling water outlet port 121, from the cooling water, which flows through the second cooling water inlet port 112 and the second cooling water outlet port 122, and thus prevent mixing between both the cooling water. The first side partition wall 212 may extend a predetermined distance toward the opposite side from the one side of the first heat-exchanging plate 200 such that the cooling water, which is introduced through the first cooling water inlet port 111, flows along the first side partition wall 212 in a bypass fashion for an increased heat-exchanging area of the first heat-exchanging plate 200 without directly flowing to the first cooling water outlet port 121. The second side partition wall 213 may extend a predetermined distance toward the one side from the opposite side of the first heat-exchanging plate 200 such that the cooling water, which is introduced through the second cooling water inlet port 112, flows along the second side partition wall 213 in a bypass fashion for an increased heat-exchanging area of the first heat-exchanging plate 200 without directly flowing to the second cooling water outlet port 122.

Consequently, since the first heat-exchanging plate 200 is constructed such that the first and second cooling water, which are introduced through the different cooling air inlet ports 110, are separately circulated in the first heat-exchanging plate 200, the first and second cooling water may exchange heat with the refrigerant circulating in the second heat-exchanging plate 300.

Meanwhile, the second guide 310 may include a second central partition wall 311 disposed between the refrigerant inlet port 130 and the refrigerant outlet port 140, a third side partition wall 312, which extends toward the one side from the second central partition wall 311, and a fourth side partition wall 313, which extends toward the opposite side from the second central partition wall 311.

As illustrated in FIG. 5, the second guide 310 may be composed of the second central partition wall 311, the third side partition wall 312, and the fourth side partition wall 313. Here, the second central partition wall 311 may be formed at a location of the center area of the second heat-exchanging plate 300 corresponding to the first central partition wall 211 of the first heat-exchanging plate 200. Specifically, the second central partition wall 311 may be positioned between the refrigerant inlet port 130 and the refrigerant outlet port 140, and may extend a predetermined distance across the center area of the second heat-exchanging plate 300. From the second central partition wall 311, the third side partition wall 312 may extend a predetermined distance toward the one side, and the fourth side partition wall 313 may extend a predetermined distance toward the opposite side. As a result, the refrigerant, which is introduced through the refrigerant inlet port 130, flows to the refrigerant outlet port 140 along the third side partition wall 312 and the fourth side partition wall 313 in a bypass fashion without directly flowing to the refrigerant outlet port 140, thereby providing the second heat-exchanging plate 300 with an increased heat-exchanging area.

Consequently, since the refrigerant, which is introduced through the refrigerant inlet port 130, is circulated in second heat-exchanging plate 300 by virtue of the second guide 310, the refrigerant may exchange heat with the cooling water circulating in the first heat-exchanging plate 200.

The first guide 210 and the second guide 310 will now be described in more detail. The first central partition wall 211 and the second central partition wall 311 may be positioned so as to correspond to each other in a vertical direction, and one of the engaging portions A of the first central partition wall 211 and the second central partition wall 311 may be inserted into the other of the engaging portions A.

In this way, since the first central partition wall 211 and the second central partition wall 311 overlap each other such that one of the engaging portions A thereof is inserted upwards into the other of the engaging portions A, direct flow of the cooling water or the refrigerant is blocked, and reliable coupling between the first heat-exchanging plate 200 and the second heat-exchanging plate 300 is assured. When the first heat-exchanging plate 200 and the second heat-exchanging plate 300 are welded to each other, brazing may be employed. In this case, since the first central partition wall 211 and the second central partition wall 311 overlap each other such that one of the first central partition wall 211 and the second central partition wall 311 is inserted into the other of the first central partition wall 211 and the second central partition wall 311, a sufficient contact area is assured, and thus coupling rigidity between the first and second heat-exchanging plates 200 and 300 is increased.

Specifically, the first central partition wall 211 may project upwards such that the engaging portion A of the first central partition wall 211 that is engaged with the second central partition wall 311 is inserted upwards into the second central partition wall 311, and the remaining portion B of the first central partition wall 211 is brought into contact with the lower surface of the second heat-exchanging plate 300. The second central partition wall 311 may project so as to be inserted into the first central partition wall 211.

In other words, the engaging portion A of the first central partition wall 211 that is engaged with the second central partition wall 311 may project upwards, and the second central partition wall 311, which corresponds to the first central partition wall 211, may also project upwards, with the result that one of the first central partition wall 211 and the second central partition wall 311 is vertically inserted into the other of the first central partition wall 211 and the second central partition wall 311 so as to form an overlapping structure.

In an embodiment of the present disclosure, the first central partition wall 211 may be constructed such that only the engaging portion A of the first central partition wall 211 that is engaged with the second central partition wall 311 projects highly so as to be inserted into the second central partition wall 311, and the remaining portion B of the first central partition wall 211 that is not engaged with the second central partition wall 311 projects shortly so as to be coupled to the lower surface of the second heat-exchanging plate 300. Consequently, the engaging portions A of the first central partition wall 211 and the second central partition wall 311 may prevent the cooling water and the refrigerant from flowing in the first heat-exchanging plate 200 and the second heat-exchanging plate 300, respectively, and the remaining portion B of the first central partition wall 211, which projects shortly, may be coupled to the lower surface of the second heat-exchanging plate 300 so as to avoid interference with the refrigerant channel.

Furthermore, the first heat-exchanging plate 200 may be provided with a first insertion portion 240, which is formed at a location at which the higher engaging portion A meets the lower remaining portion B and which gradually decreases in width moving upwards, and the second heat-exchanging plate 300 may be provided with a second insertion portion 340, which is formed at a location on the second central partition wall 311 corresponding to the first insertion portion 240 and which has the same shape as the first insertion portion 240.

Although each of the first insertion portion 240 and the second insertion portion 340 is shown as having a truncated conical shape which gradually decreases in width moving upwards in FIGS. 4 and 5, various shapes, such as a trigonal pyramid shape and a rhombic pyramid shape, may be applied. Furthermore, since each of the first insertion portion 240 and the second insertion portion 340 is constructed such that the width thereof gradually decreases moving upwards, it is easy to insert one of the insertion portions into the other and to assure a sufficient contact area.

As described above, since the first heat-exchanging plate 200 is provided with the first insertion portion 240 and the second heat-exchanging plate 300 is provided with the second insertion portion 340 such that one of the first insertion portion 240 and the second insertion portion 340 is inserted into the other of the first insertion portion 240 and the second insertion portion 340 so as to form an overlapping structure, coupling rigidity between first and second heat-exchanging plates 200 and 300 may be increased by virtue of the increased contact area when the first heat-exchanging plate 200 and the second heat-exchanging plate 300 are welded to each other. Furthermore, since the first insertion portion 240 is formed at a location on the first central partition wall 211 at which the higher portion thereof meets the lower portion thereof and the second insertion portion 340 is formed at a location on the second central partition wall 311 corresponding to the first insertion portion 240, it is possible to assure rigidity of each of the central partition walls.

The first side partition wall 212 and the third side partition wall 312 may be positioned so as to correspond to each other in a vertical direction, and one of the engaging portions A of the first side partition wall 212 and the third side partition wall 312 may be inserted into the other of the engaging portions A of the first side partition wall 212 and the third side partition wall 312. The second side partition wall 213 and the fourth side partition wall 313 may be positioned so as to correspond to each other in a vertical direction, and one of the engaging portions A of the second side partition wall 213 and the fourth side partition wall 313 may be inserted into the other of the engaging portions A of the second side partition wall 213 and the fourth side partition wall 313.

In this way, since the first side partition wall 212 and the third side partition wall 312 overlap each other such that one of the engaging portions A thereof is inserted upwards into the other of the engaging portions A and the second side partition wall 213 and the fourth side partition wall 313 overlap each other such that one of the engaging portions A thereof is inserted upwards into the other of the engaging portions A, direct flow of the cooling water or the refrigerant is blocked, and reliable coupling between the first heat-exchanging plate 200 and the second heat-exchanging plate 300 is assured. When the first heat-exchanging plate 200 and the second heat-exchanging plate 300 are welded to each other, brazing may be employed. In this case, since the first side partition wall 212 and the third side partition wall 312 overlap each other such that one of the first side partition wall 212 and the third side partition wall 312 is inserted into the other of the first side partition wall 212 and the third side partition wall 312 and the second side partition wall 213 and the fourth side partition wall 313 overlap each other such that one of the second side partition wall 213 and the fourth side partition wall 313 is inserted into the other of the second side partition wall 213 and the fourth side partition wall 313, a sufficient contact area is assured, and thus coupling rigidity between the first and second heat-exchanging plates 200 and 300 is increased.

Specifically, the first side partition wall 212 may project upwards such that the engaging portion A of the first side partition wall 212 that is engaged with the third side partition wall 312 is inserted upwards into the third side partition wall 312, and the remaining portion B of the first side partition wall 212 is brought into contact with the lower surface of the second heat-exchanging plate 300. The third side partition wall 312 may project upwards such that the engaging portion A of the third side partition wall 312 that is engaged with the first side partition wall 212 is inserted upwards into the first side partition wall 212, and the remaining portion B of the third side partition wall 312 is brought into contact with the lower surface of the first heat-exchanging plate 200.

In other words, the engaging portion A of the first side partition wall 212 that is engaged with the third side partition wall 312 may project upwards, and the third side partition wall 312, which corresponds to the first side partition wall 212, may also project upwards, with the result that one of the first side partition wall 212 and the third side partition wall 312 is vertically inserted into the other of the first side partition wall 212 and the third side partition wall 312 so as to form an overlapping structure.

In an embodiment of the present disclosure, the first side partition wall 212 may be constructed such that only the engaging portion A of the first side partition wall 212 that is engaged with the third side partition wall 312 projects highly so as to be inserted into the third side partition wall 312, and the remaining portion B of the first side partition wall 212 that is not engaged with the third side partition wall 312 projects shortly so as to be coupled to the lower surface of the second heat-exchanging plate 300. Consequently, the engaging portions A of the first side partition wall 212 and the third side partition wall 312 may prevent the cooling water and the refrigerant from flowing in the first heat-exchanging plate 200 and the second heat-exchanging plate 300, respectively. The remaining portion B of the first side partition wall 212, which projects shortly, may be coupled to the lower surface of the second heat-exchanging plate 300 so as to form the refrigerant channel on the upper surface of the second heat-exchanging plate 300, and the remaining portion B of the third side partition wall 312, which projects shortly, may be coupled to the lower surface of the first heat-exchanging plate 200 so as to form the refrigerant channel on the upper surface of the first heat-exchanging plate 200.

Similarly, the engaging portions A of the second side partition wall 213 and the fourth side partition wall 313 may prevent the cooling water and the refrigerant from flowing in the first heat-exchanging plate 200 and the second heat-exchanging plate 300, respectively. The remaining portion B of the second side partition wall 213, which projects shortly, may be coupled to the lower surface of the second heat-exchanging plate 300 so as to form the refrigerant channel on the upper surface of the second heat-exchanging plate 300, and the remaining portion B of the fourth side partition wall 313, which projects shortly, may be coupled to the lower surface of the first heat-exchanging plate 200 so as to form the refrigerant channel on the upper surface of the first heat-exchanging plate 200.

Furthermore, the first heat-exchanging plate 200 may be provided with first insertion portions 240, which are respectively formed at a location at which the higher engaging portion A meets the lower remaining portion B and at the end of the first side partition wall 212 and each of which gradually decreases in width moving upwards, and the second heat-exchanging plate 300 may be provided with second insertion portions 340, which are formed at locations on the third side partition wall 312 corresponding to the first insertion portions 240 and each of which has the same shape as a corresponding one of the first insertion portions 240.

As described above, since the first heat-exchanging plate 200 is provided with the first insertion portions 240 and the second heat-exchanging plate 300 is provided with the second insertion portions 340 such that the first insertion portions 240 are inserted into the second insertion portions 340 and the second insertion portions 340 are inserted into the first insertion portion 240 so as to form an overlapping structure, coupling rigidity between first and second heat-exchanging plates 200 and 300 may be increased by virtue of the increased contact area when the first heat-exchanging plate 200 and the second heat-exchanging plate 300 are welded to each other. Furthermore, since the first insertion portions 240 are formed at locations on the first side partition wall 212 at which the higher portion thereof meets the lower portion thereof and at the end of first side partition wall 212, and the second insertion portions 340 are formed at locations on the third side partition wall 312 corresponding to the first insertion portions 240, it is possible to assure rigidity of each of the side partition walls.

Meanwhile, the engaging portion A of the second side partition wall 213 that is engaged with the fourth side partition wall 313 may project so as to be inserted into the fourth side partition wall 313, and the remaining portion B of the second side partition 213 may project so as to be in contact with the second heat-exchanging plate 300. The engaging portion A of the fourth side partition wall 313 that is engaged with the second side partition wall 213 may project so as to be inserted into the second side partition wall 213, and the remaining portion B of the fourth side partition 313 may project so as to be in contact with the first heat-exchanging plate 200.

In other words, the second side partition wall 213 may be constructed such that only the engaging portion A of the second side partition wall 213 that is engaged with the fourth side partition wall 313 projects highly so as to be inserted into the fourth side partition wall 313, and the remaining portion B of the second side partition wall 213 that is not engaged with the fourth side partition wall 313 projects shortly so as to be coupled to the lower surface of the second heat-exchanging plate 300. Consequently, the engaging portions A of the second side partition wall 213 and the fourth side partition wall 313 may prevent the cooling water and the refrigerant from flowing in the first heat-exchanging plate 200 and the second heat-exchanging plate 300, respectively. The remaining portion B of the second side partition wall 213, which projects shortly, may be coupled to the lower surface of the second heat-exchanging plate 300 so as to form the refrigerant channel on the upper surface of the second heat-exchanging plate 300, and the remaining portion B of the fourth side partition wall 313, which projects shortly, may be coupled to the lower surface of the first heat-exchanging plate 200 so as to form the refrigerant channel on the upper surface of the first heat-exchanging plate 200.

Similarly, the engaging portions A of the fourth side partition wall 313 and the second side partition wall 213 may prevent the cooling water and the refrigerant from flowing in the first heat-exchanging plate 200 and the second heat-exchanging plate 300, respectively. The remaining portion B of the second side partition wall 213, which projects shortly, may be coupled to the lower surface of the second heat-exchanging plate 300 so as to form the refrigerant channel on the upper surface of the second heat-exchanging plate 300, and the remaining portion B of the fourth side partition wall 313, which projects shortly, may be coupled to the lower surface of the first heat-exchanging plate 200 so as to form the refrigerant channel on the upper surface of the first heat-exchanging plate 200.

Here, the first heat-exchanging plate 200 may be provided with first insertion portions 240, which are respectively formed at a location at which the higher engaging portion A meets the lower remaining portion B and at the end of the second side partition wall 213 and each of which gradually decreases in width moving upwards, and the second heat-exchanging plate 300 may be provided with second insertion portions 340, which are formed at locations on the fourth side partition wall 313 corresponding to the first insertion portions 240 and each of which has the same shape as a corresponding one of the first insertion portions 240.

As described above, since the first heat-exchanging plate 200 is provided with the first insertion portions 240 and the second heat-exchanging plate 300 is provided with the second insertion portions 340 such that the first insertion portions 240 are inserted into the second insertion portions 340 and the second insertion portions 340 are inserted into the first insertion portion 240 so as to form an overlapping structure, coupling rigidity between first and second heat-exchanging plates 200 and 300 may be increased by virtue of the increased contact area when the first heat-exchanging plate 200 and the second heat-exchanging plate 300 are welded to each other. Furthermore, since the first insertion portions 240 are formed at locations on the second side partition wall 213 at which the higher portion thereof meets the lower portion thereof and at the end of second side partition wall 213 and the second insertion portions 340 are formed at locations on the fourth side partition wall 313 corresponding to the first insertion portions 240, it is possible to assure rigidity of each of the side partition walls.

The portions of the first guide 210 that abut the peripheral edge of the first heat-exchanging plate 200 and the portions of the second guide 310 that abut the peripheral edge of the second heat-exchanging plate 300 may be constructed so as to gradually increase in width moving outwards.

As illustrated in FIGS. 4 and 5, the first guide 210 may extend from the peripheral edge of the first heat-exchanging plate 200, and the second guide 310 may extend from the peripheral edge of the second heat-exchanging plate 300. Here, since the portions of the first guide 210 that abut the peripheral edge of the first heat-exchanging plate 200 and the portion of the second guide 310 that abuts the peripheral edge of the second heat-exchanging plate 300 are respectively constructed so as to have a "Y" shape, which increases in width outwards, it is possible to assure moldability and durability of the first guide 210 and the second guide 310.

Each of the first heat-exchanging plate 200 and the second heat-exchanging plate 300 may be provided with a plurality of protrusions D. In other words, since each of the first heat-exchanging plate 200 and the second heat-exchanging plate 300 is provided on one side surface thereof with the plurality of protrusions D, efficiency of heat exchange with cooling water or refrigerant is improved. The plurality of protrusions D may be formed on the upper surface or both the upper surface and the lower surface of each of the first heat-exchanging plate 200 and the second heat-exchanging plate 300, and may be distributed throughout one side surface of each of the first heat-exchanging plate 200 and the second heat-exchanging plate 300 except the locations at which the first guide 210 and the second guide 310 are formed.

Each of the first heat-exchanging plate 200 and the second heat-exchanging plate 300 may be provided at the peripheral edge thereof with an extension C, which extends obliquely upwards or downwards. The extensions C of the first heat-exchanging plate 200 and the second heat-exchanging plate 300 may be in contact with each other when the first heat-exchanging plate 200 and the second heat-exchanging plate 300 are layered.

As illustrated in FIGS. 6 and 7, since each of the first heat-exchanging plate 200 and the second heat-exchanging plate 300 is provided at the peripheral edge thereof with the extension C, which extends obliquely upwards or downwards, it is possible to increase coupling capability by virtue of the increased contact area when the first heat-exchanging plate 200 and the second heat-exchanging plate 300 are layered.

As illustrated in FIG. 6, the first heat-exchanging plate 200 and the second heat-exchanging plate 300 are layered so as to form an overlapping structure. Cooling water is introduced into the first heat-exchanging plate 200 through the cooling water inlet port 110 and is discharged through the cooling water outlet port 120, and refrigerant is introduced into the refrigerant inlet port 130 and is discharged through the refrigerant outlet port 140. As a result, the cooling water and the refrigerant may exchange heat with each other via the first heat-exchanging plate 200 and the second heat-exchanging plate 300.

As is apparent from the above description, since the heat exchanger according to the present disclosure, which is constructed as described above, is constructed such that the first heat-exchanging plate 200, in which plural kinds of cooling water are circulated, and the second heat-exchanging plate 300, in which refrigerant is circulated, have respective independent flow channels, mixing between the cooling water and the refrigerant is prevented.

Particularly, since the first guide 210 of the first heat-exchanging plate 200 and the second guide 310 of the second heat-exchanging plate 300 are layered so as to form an overlapping structure, coupling capability and durability are improved when the first heat-exchanging plate 200 and the second heat-exchanging plate 300 are welded to each other in the state of being layered.

In embodiments, a heat exchanger includes a housing, a plurality of first heat-exchanging plates, and a plurality of second heat-exchanging plates. The housing includes first and second cooling water inlet ports and first and second cooling water outlet ports, through which cooling water flows. The housing further includes a refrigerant inlet port and a refrigerant outlet port, through which refrigerant flows.

The plurality of first heat-exchanging plates and the plurality of second heat-exchanging plates are alternately layered to form an alternately layered structure.

In the alternately layered structure, between an upper surface of a first one of the first heat-exchanging plates and a lower surface of a first one of the second heat-exchanging plates placed above the first one of the first heat-exchanging plates, a water flow space is formed. To form one or more water flow channels, each first heat-exchanging plate includes a first flow guide system that includes a plurality of first partition walls protruding from the upper surface of each first heat-exchanging plate.

In the alternately layered structure, between an upper surface of the first one of the second heat-exchanging plates and a lower surface of a second one of the first heat-exchanging plates placed above the first one of the second heat-exchanging plates, a refrigerant flow space is formed. To form one or more refrigerant flow channels, each second heat-exchanging plate includes a second flow guide system that includes a plurality of second partition walls protruding from the upper surface of each second heat-exchanging plate.

In embodiments, at lower surface of each first heat-exchanging plate, one or more of the first partition walls may include grooves that can receive top portions of one or more of the second partition walls. Similarly, at lower surface of each second heat-exchanging plate, one or more of the second partition walls may include grooves that can receive top portions of one or more of the first partition walls.

In embodiments, one or more of the first partition walls may include top portions abutting the lower surface of the second heat-exchanging plate. One or more of the second partition walls may include top portions abutting the lower surface of the first heat-exchanging plate.

Although embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A heat exchanger comprising:

a housing comprising first and second cooling water inlet ports and first and second cooling water outlet ports, through which cooling water is circulated, and a refrigerant inlet port and a refrigerant outlet port, through which refrigerant is circulated;

a plurality of first heat-exchanging plates, each of which is connected to the first and second cooling water inlet ports and the first and second cooling water outlet ports and comprises a first guide configured to define a cooling water channel; and a plurality of second heat-exchanging plates, each of which is connected to the refrigerant inlet port and the refrigerant outlet port and comprises a second guide configured to define a refrigerant channel, wherein the plurality of first heat-exchanging plates and the plurality of second heat-exchanging plates are alternately layered, and wherein the first guide and the second guide form an overlapping structure such that one of the first guide and the second guide is inserted into the other of the first guide and the second guide when the first heat-exchanging plates and the second heat-exchanging plates are layered, wherein the first guide comprises a first central partition wall, which extends at a central area on the first heat-exchanging plate to divide the first heat-exchanging plate into a first side and a second side, a first side partition wall, which extends toward the second side from the first side of the first heat-exchanging plate to define a cooling water channel between the first cooling inlet and the first cooling water outlet port, and a second side partition wall, which extends toward the first side from the second side of the first heat-exchanging plate to define a cooling water channel between the second cooling water inlet port and the second cooling water outlet port, wherein the second guide comprises a second central partition wall disposed between the refrigerant inlet port and the refrigerant outlet port, a third side partition wall, which extends toward the first side from the second central partition wall, and a fourth side partition wall, which extends toward the second side from the second central partition wall, wherein the first side partition wall and the third side partition wall are positioned so as to correspond to each other in a vertical direction and to be partially engaged with each other, and one of the engaging portions of the first side partition wall and the third side partition wall is inserted into another of the first side partition wall and the third side partition wall, and wherein the second side partition wall and the fourth side partition wall are positioned so as to correspond to each other in a vertical direction and to be partially engaged with each other, and one of the engaging portions of the second side partition wall and the fourth side partition wall is inserted into another of the second side partition wall and the fourth side partition wall.

2. The heat exchanger according to claim 1, wherein the first cooling water inlet port and the first cooling water outlet port are provided at a first side of an upper portion of the housing, and the second cooling water inlet port and the second cooling water outlet port are provided at a second side of the upper portion of the housing, and wherein the refrigerant inlet port and the refrigerant outlet port are provided at portions of the housing which do not overlap the first cooling water inlet port or the second cooling water inlet port.

3. The heat exchanger according to claim 1, wherein each first heat-exchanging plate is provided at a first side and a second side thereof with cooling water holes, which are respectively in communication with the first cooling water inlet port, the first cooling water outlet port, the second cooling water inlet port, and the second cooling water outlet port so as to allow cooling water to be circulated therethrough, and each first heat-exchanging plate is provided in a central area thereof with first through holes, through which the refrigerant inlet port and the refrigerant outlet port extend.

4. The heat exchanger according to claim 1, wherein the second heat-exchanging plate is provided at a first side and a second side thereof with second through holes, through which the first cooling water inlet port, the first cooling water outlet port, the second cooling water inlet port, and the second cooling water outlet port extend, and the second heat-exchanging plate is provided in a central area thereof with refrigerant holes, which are in communication with the refrigerant inlet port and the refrigerant outlet port.

5. The heat exchanger according to claim 1, wherein the first central partition wall and the second central partition wall are positioned so as to correspond to each other in a vertical direction and to be partially engaged with each other, and one of engaging portions of the first central partition wall and the second central partition wall is inserted into another of the first central partition wall and the second central partition wall.

6. The heat exchanger according to claim 5, wherein the engaging portion of the first central partition wall that is engaged with the second central partition wall projects so as to be inserted into the second central partition wall, and a remaining portion of the first central partition wall projects so as to be in contact with a lower surface of the second heat-exchanging plate, and wherein the second central partition wall projects so as to be inserted into the first central partition wall.

7. The heat exchanger according to claim 6, wherein the first heat-exchanging plate comprises a first insertion portion, which is formed at a location at which the engaging portion of the first central partition wall meets the remaining portion of the first central partition wall and which gradually decreases in width moving upwards, and the second heat-exchanging plate comprises a second insertion portion, which is formed at a location on the second central partition wall corresponding to the first insertion portion and which is identical in shape to the first insertion portion.

8. The heat exchanger according to claim 1, wherein the engaging portion of the first side partition wall that is engaged with the third side partition wall projects so as to be inserted into the third side partition wall, and a remaining portion of the first side partition wall projects so as to be in contact with the second heat-exchanging plate, and wherein the engaging portion of the third side partition wall that is engaged with the first side partition wall projects so as to be inserted into the first side partition wall, and a remaining portion of the third side partition wall projects so as to be in contact with the first heat-exchanging plate.

9. The heat exchanger according to claim 8, wherein the first heat-exchanging plate comprises first insertion portions, which are formed at a location at which the engaging portion of the first side partition wall meets the remaining portion of the first side partition wall and at an end of the first side partition wall and each of which gradually decreases in width moving upwards, and the second heat-exchanging plate comprises second insertion portions, which are formed at locations on the third side partition wall corresponding to the first insertion portions and each of which is identical in shape to a corresponding one of the first insertion portions.

10. The heat exchanger according to claim 1, wherein the engaging portion of the second side partition wall that is engaged with the fourth side partition wall projects so as to be inserted into the fourth side partition wall, and a remaining portion of the second side partition wall projects so as to be in contact with the second heat-exchanging plate, and wherein the engaging portion of the fourth side partition wall that is engaged with the second side partition wall projects so as to be inserted into the second side partition wall, and a remaining portion of the fourth side partition wall projects so as to be in contact with the first heat-exchanging plate.

11. The heat exchanger according to claim 10, wherein the first heat-exchanging plate comprises first insertion portions, which are formed at a location at which the engaging portion of the second side partition wall meets the remaining portion of the second side partition wall and at an end of the second side partition wall and each of which gradually decreases in width moving upwards, and the second heat-exchanging plate comprises second insertion portions, which are formed at locations on the fourth side partition wall corresponding to the first insertion portions and each of which is identical in shape to a corresponding one of the first insertion portions.

12. The heat exchanger according to claim 1, wherein each of a portion of the first guide, which abuts a peripheral edge of the first heat-exchanging plate, and a portion of the second guide, which abuts a peripheral edge of the second heat-exchanging plate, gradually increases in width moving outwards.

13. The heat exchanger according to claim 1, wherein each of the first heat-exchanging plate and the second heat-exchanging plate comprises a plurality of protrusions formed thereon.

14. The heat exchanger according to claim 1, wherein each of the first heat-exchanging plate and the second heat-exchanging plate comprises an extension, which extends obliquely upwards or downwards from a peripheral edge thereof, and the extension of the first heat-exchanging plate and the extension of the second heat-exchanging plate are in contact with each other when the first heat-exchanging plates and the second heat-exchanging plates are layered.

* * * * *